US005868393A

United States Patent [19]

Williams

[11] Patent Number: 5,868,393

[45] Date of Patent: Feb. 9, 1999

[54] METHOD OF PLAYING A MATCH GAME

[76] Inventor: Lillie E. Williams, 2895 E. Charleston Blvd. #1051, Las Vegas, Nev. 89104

[21] Appl. No.: 961,636

[22] Filed: Oct. 30, 1997

[51] Int. Cl.[6] ..... A63F 1/00

[52] U.S. Cl. ..... 273/299; 273/302; 434/157; 434/191; 434/205

[58] Field of Search ..... 273/299, 302, 273/272, 273; 434/159, 172, 205, 191

[56] References Cited

U.S. PATENT DOCUMENTS

| | | | |
|---|---|---|---|
| 3,081,560 | 3/1963 | Campo Agud | 434/157 |
| 4,281,835 | 8/1981 | Seiden | 273/299 |
| 5,040,987 | 8/1991 | Frazier | 434/188 |
| 5,639,091 | 6/1997 | Morales | 273/299 |

FOREIGN PATENT DOCUMENTS

| | | | |
|---|---|---|---|
| 204157 | 8/1923 | United Kingdom | 434/205 |

*Primary Examiner*—Benjamin H. Layno

[57] ABSTRACT

A match game is provided including a deck of rectangular cards each having a first face with a common design thereon and a second face. Each deck of rectangular cards includes a plurality of numeric cards with an English numeral positioned on the second face, an English alphabetic representation of the numeral positioned on the second face, and a Spanish alphabetic representation of the numeral positioned on the second face.

1 Claim, 3 Drawing Sheets

METHOD OF PLAYING A MATCH GAME

BACKGROUND OF THE INVENTION

1. Field of the Invention

The present invention relates to educational games and more particularly pertains to a new match game for teaching a user arithmetic skills, foreign language, and memory skills.

2. Description of the Prior Art

The use of educational games is known in the prior art. More specifically, educational games heretofore devised and utilized are known to consist basically of familiar, expected and obvious structural configurations, notwithstanding the myriad of designs encompassed by the crowded prior art which have been developed for the fulfillment of countless objectives and requirements.

Known prior art educational games include U.S. Pat. No. 4,940,240; U.S. Pat. No. 4,281,835; U.S. Pat. Des. No. 291,458; U.S. Pat. No. 4,561,658; U.S. Pat. No. 4,884,974; and U.S. Pat. No. 5,033,754.

In these respects, the match game according to the present invention substantially departs from the conventional concepts and designs of the prior art, and in so doing provides an apparatus primarily developed for the purpose of teaching a user arithmetic skills, foreign language, and memory skills.

SUMMARY OF THE INVENTION

In view of the foregoing disadvantages inherent in the known types of educational games now present in the prior art, the present invention provides a new match game construction wherein the same can be utilized for teaching a user arithmetic skills, foreign language, and memory skills.

The general purpose of the present invention, which will be described subsequently in greater detail, is to provide a new match game apparatus and method which has many of the advantages of the educational games mentioned heretofore and many novel features that result in a new match game which is not anticipated, rendered obvious, suggested, or even implied by any of the prior art educational games, either alone or in any combination thereof.

To attain this, the present invention generally comprises a pair of decks of rectangular cards. Each card has a first face with a common design thereon and a second face. As shown in FIG. 6, each deck of rectangular cards includes a plurality of numeric cards. Such numeric cards are equipped with an English numeral positioned at a center of the second face. Further, an English alphabetic representation of the numeral is situated at an upper left extent of the second face and a Spanish alphabetic representation of the numeral is situated at a lower left extent of the second face. An amount of linearly aligned dots are positioned below the numeral, wherein such amount is equal to the numeral. Each deck of cards further include a plurality of operation cards each having a subtraction sign, addition sign, or an equal sign positioned on a central extent of the second face. Note FIGS. 3–5. The decks of cards include a first deck of cards having a unique first design on the first faces thereof. The numerals of each card of the present deck ranges between 1 and 10. See FIG. 6. As shown in FIG. 7, a second deck of cards is also provided which includes a unique second design on the first face thereof with the numerals thereof ranging between 11 and 20.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new match game apparatus and method which has many of the advantages of the educational games mentioned heretofore and many novel features that result in a new match game which is not anticipated, rendered obvious, suggested, or even implied by any of the prior art educational games, either alone or in any combination thereof.

It is another object of the present invention to provide a new match game which may be easily and efficiently manufactured and marketed.

It is a further object of the present invention to provide a new match game which is of a durable and reliable construction.

An even further object of the present invention is to provide a new match game which is susceptible of a low cost of manufacture with regard to both materials and labor, and which accordingly is then susceptible of low prices of sale to the consuming public, thereby making such match game economically available to the buying public.

Still yet another object of the present invention is to provide a new match game which provides in the apparatuses and methods of the prior art some of the advantages thereof, while simultaneously overcoming some of the disadvantages normally associated therewith.

Still another object of the present invention is to provide a new match game for teaching a user arithmetic skills, foreign language, and memory skills.

Even still another object of the present invention is to provide a new match game that includes a deck of rectangular cards each having a first face with a common design thereon and a second face. Each deck of rectangular cards includes a plurality of numeric cards with an English numeral positioned on the second face, an English alphabetic representation of the numeral positioned on the second face, and a Spanish alphabetic representation of the numeral positioned on the second face.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
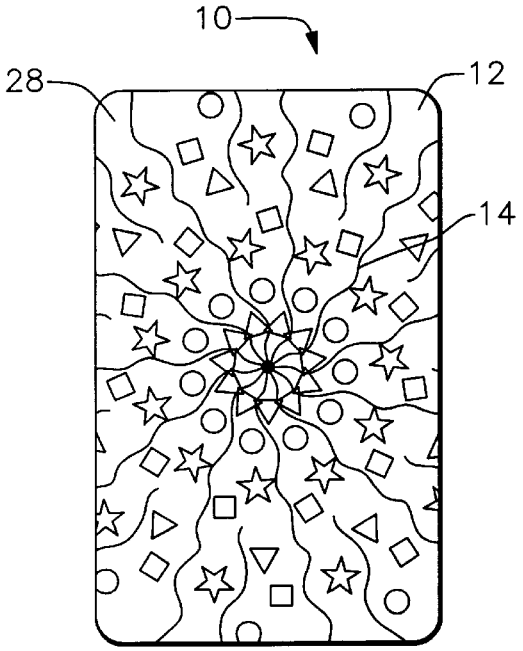
FIG. 1 is an illustration of the first face of the cards of the first deck of the present invention.
Figure 2:
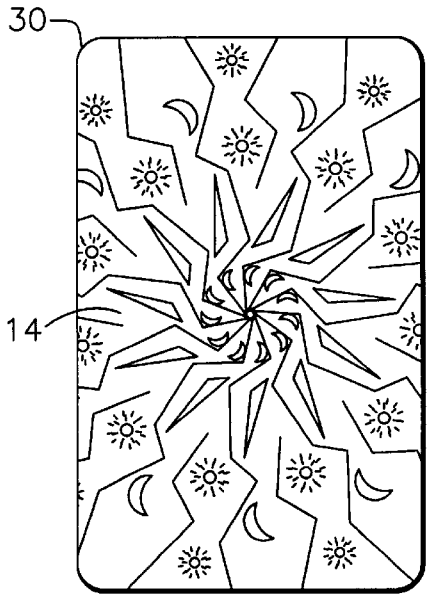
FIG. 2 is an illustration of the first face of the cards of the second deck of the present invention.
Figure 3:
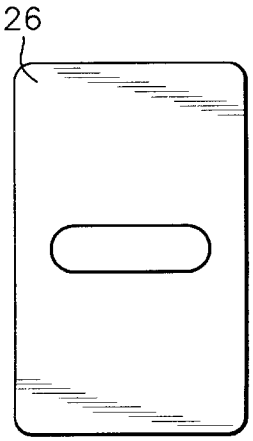
FIGS. 3–5 are illustrations of the operation cards of the present invention.
Figure 4:
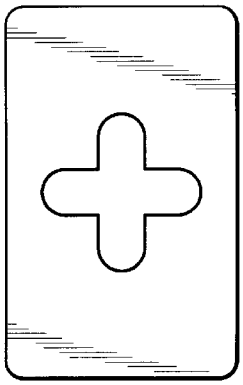
Figure 5:
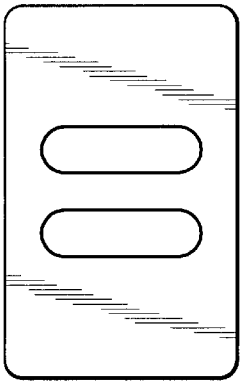

With reference now to the drawings, and in particular to FIGS. 1 through 7 thereof, a new match game embodying the principles and concepts of the present invention and generally designated by the reference numeral 10 will be described.

The present invention, as designated as numeral 10, includes a pair of decks of rectangular cards 12. Each card has a first face 14 with a common design thereon and a second face.

Figure 6:
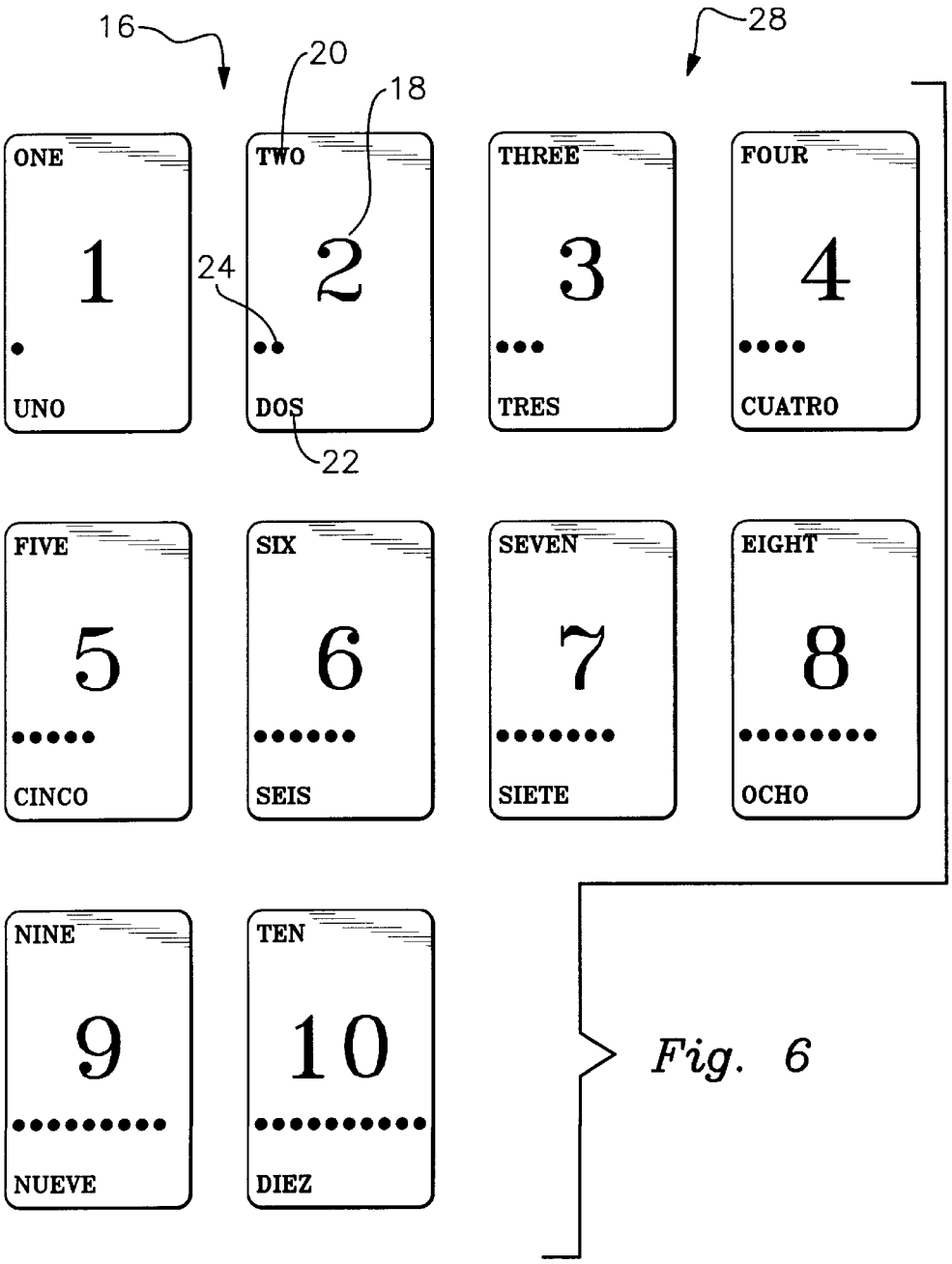
FIG. 6 is a view of the various cards of the first deck of the present invention.

As shown in FIG. 6, each deck of rectangular cards includes a plurality of numeric cards 16. Such numeric cards are equipped with an English numeral 18 positioned at a center of the second face. Further, an English alphabetic representation 20 of the numeral is situated at an upper left extent of the second face and a Spanish alphabetic representation 22 of the numeral is situated at a lower left extent of the second face. An amount of linearly aligned dots 24 are positioned below the numeral, wherein such amount is equal to the numeral. Each deck of cards further includes a plurality of operation cards 26 each having a subtraction sign, addition sign, or an equal sign positioned on a central extent of the second face. Note FIGS. 3–5.

Figure 7:
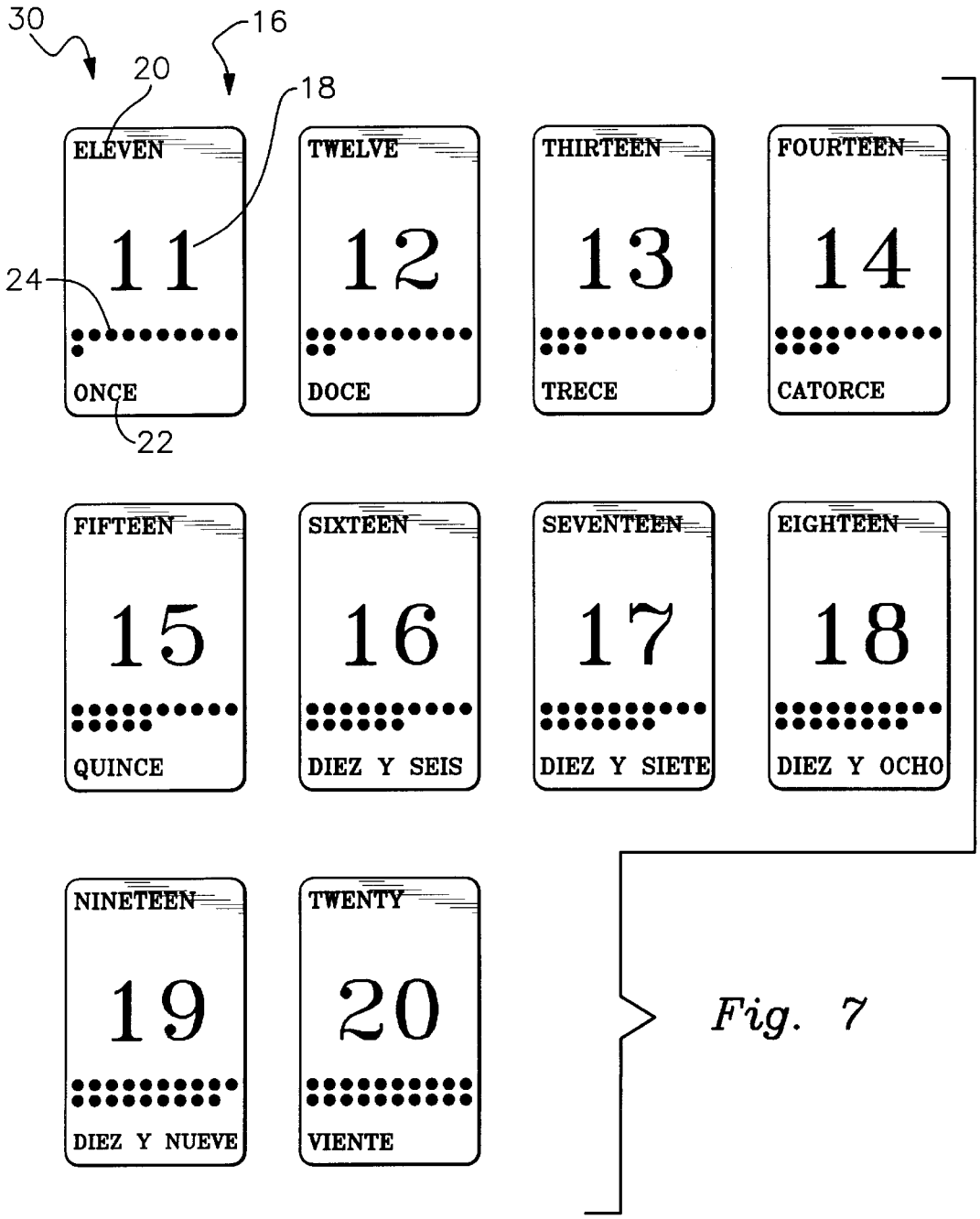
FIG. 7 is a view of the various cards of the second deck of the present invention.

The decks of cards include a first deck of cards 28 having a unique first design on the first faces thereof. The numerals of each card of the present deck ranges between 1 and 10. See FIG. 6. As shown in FIG. 7, a second deck of cards 30 is also provided which includes a unique second design on the first face thereof with the numerals thereof ranging between 11 and 20. In the preferred embodiment, each deck has 50 cards including 40 numeric cards, 4 operation cards with the addition sign, 4 operation cards with the subtraction sign and 2 operation cards with the equal sign.

The method associated with the present invention will now be set forth. Numerous games may be played with the cards of the present invention. During each game, turns are taken amongst a plurality of players. It should be noted that a player to pick a highest card takes the first turn. Prior to beginning the game each deck is shuffled and dealt face down in separate areas.

Each turn of an addition game includes the step of picking one of the cards from the second deck and subsequently picking cards from the first deck. After each card of the first deck is picked, the current player adds the numerals of each of such to generate a total. Next, the current player is granted a point, or "match", if the total of the numerals of the cards picked from the first deck is equal to the numeral of the second deck. In the alternative, the turn of the current player is skipped if the total of the numerals of the cards picked from the first deck is greater than the numeral of the second deck.

Yet another game, a subtraction game, is included wherein each turn consists of picking one of the cards from the second deck and picking cards from the first deck, similar to the addition game. In the present game, however, the current player must subtract the numerals of the picked cards of the first deck from the numeral of the card of the second deck as they are picked to generate total. Such subtraction is continued until the current player generates a total equal to zero at which point the current player is awarded a point. If, however, the total of the numerals of the cards picked from the first deck are less than zero, the turn of the current player is skipped.

Finally, a match game may be played wherein each turn includes picking one of the cards from one of the decks and another one of the cards from the similar deck. During play of the present game, the current player is granted a point only if the first card picked from the deck is the same as the second card picked. If a match is not made, the current player's turn is skipped.

A winner of the game is declared as the player who earns the most points when all of the cards are gone. It should be noted that any card that is picked wherein a point is not earned is replaced in its original position. As an option, in a single game, the operation cards may be employed to determine which of the aforementioned games may be played. For example, while playing the matching game, if the operation card with a subtraction sign is picked, the matches game then switches to the subtraction game, as so forth.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a match game comprising the steps of:

providing a pair of decks of rectangular cards each having a first face with a common design thereon and a second face, each deck of rectangular cards including: a plurality of numeric cards with an English numeral positioned at a center of the second face, an English alphabetic representation of the numeral situated at an upper left extent of the second face, a Spanish alphabetic representation of the numeral situated at a lower left extent of the second face, and an amount of linearly aligned dots positioned below the numeral with such amount equal to the numeral and a plurality of operation cards each having one of a subtraction sign, addition sign, and equal sign positioned on a central extent of the second face; said pair of decks including a first deck of cards having a unique first design on the first faces thereof with the numerals ranging between 1 and 10 and a second deck of cards having a unique second design on the first faces thereof with the numerals ranging between 11 and 20;

playing an addition game comprising the steps of:

picking one of the cards from the second deck, picking cards from the first deck, adding the numerals on each of the cards picked from the first deck as they are picked to generate a total, and granting a point to the current player if the total of the numerals on the cards picked from the first deck is equal to the numeral on the card picked from the second deck;

playing a subtraction game comprising the steps of:

picking one of the cards from the second deck, picking cards from the first deck, subtracting from the numeral on the card picked from the second deck the numerals on each of the cards picked from the first deck as they are picked to generate total, and granting a point to the current player if the total of the numerals on the cards picked is equal to zero;

playing a match game comprising the steps of:

picking one of the cards from one of the decks, picking one of the cards from deck of the previous step, and granting a point to the current player if the cards picked match; and using the operation cards to determine which of the games is played by picking the operation cards and playing the game that matches the operation card.

* * * * *